US010220406B2

(12) United States Patent
Kang

(10) Patent No.: US 10,220,406 B2
(45) Date of Patent: Mar. 5, 2019

(54) APPLICATOR HAVING PRESS BUTTON FOR DISCHARGING GEL-TYPE CONTENTS

(71) Applicant: Sungil Kang, Seongnam-si (KR)

(72) Inventor: Sungil Kang, Seongnam-si (KR)

( * ) Notice: Subject to any disclaimer, the term of this patent is extended or adjusted under 35 U.S.C. 154(b) by 95 days.

(21) Appl. No.: 15/536,641

(22) PCT Filed: Dec. 14, 2015

(86) PCT No.: PCT/KR2015/013650

§ 371 (c)(1),
(2) Date: Jun. 16, 2017

(87) PCT Pub. No.: WO2016/099089

PCT Pub. Date: Jun. 23, 2016

(65) Prior Publication Data

US 2017/0341102 A1 Nov. 30, 2017

(30) Foreign Application Priority Data

Dec. 16, 2014 (KR) ..... 20-2014-0009265 U

(51) Int. Cl.
*B05C 1/06* (2006.01)
*A45D 34/04* (2006.01)
(Continued)

(52) U.S. Cl.
CPC ..... *B05C 1/06* (2013.01); *A45D 34/042* (2013.01); *B05B 11/303* (2013.01);
(Continued)

(58) Field of Classification Search
CPC . B05C 1/06; B05C 17/00569; B05C 17/0116; B05B 11/303; B05B 11/3032; A45D 34/042
See application file for complete search history.

(56) References Cited

U.S. PATENT DOCUMENTS 2,743,042 A * 4/1956 Burgin ..... A46B 11/0055 222/191
4,883,204 A * 11/1989 Kay ..... A45D 34/042 222/192

(Continued)

FOREIGN PATENT DOCUMENTS

JP 11-206453 A 8/1999
KR 20-0421361 Y1 7/2006

(Continued)

*Primary Examiner* — Nicholas J. Weiss
(74) *Attorney, Agent, or Firm* — Heedong Chae; Lucem, PC

(57) ABSTRACT

The present invention relates to an applicator having a press button for discharging gel-type contents, and more specifically, an applicator having a press button for discharging gel-type contents, the applicator comprising: a pump embedded in a container body; a pressing member coupled to the upper side of the pump; a link coupled to the pressing member; and a press button formed on the outside of the link. If the press button is pressed, the link is pressed, then the pressing member connected to the link presses the pump vertically, and thereby the gel-type contents filled in the container body are pumped, and discharged through a discharge member. Thus, a predetermined amount of gel-type contents can always easily be discharged for use.

20 Claims, 6 Drawing Sheets

(51) Int. Cl.
*B05B 11/00* (2006.01)
*B05C 17/01* (2006.01)
*B05C 17/005* (2006.01)

(52) U.S. Cl.
CPC .... *B05B 11/3032* (2013.01); *B05C 17/00569* (2013.01); *B05C 17/0116* (2013.01); *B05B 11/00416* (2018.08)

(56) References Cited

U.S. PATENT DOCUMENTS

| | | | | | |
|---|---|---|---|---|---|
| 6,056,470 | A * | 5/2000 | Nehashi | A45D 34/042 | 401/176 |
| 8,308,386 | B2 * | 11/2012 | Ki | A45D 34/042 | 401/176 |
| 8,985,885 | B2 * | 3/2015 | Kang | A45D 34/042 | 222/383.1 |
| 2003/0185620 | A1 * | 10/2003 | Park | A46B 11/0055 | 401/270 |
| 2005/0169695 | A1 * | 8/2005 | Noguchi | A45D 34/04 | 401/277 |
| 2008/0296320 | A1 * | 12/2008 | Kang | A45D 34/042 | 401/176 |
| 2009/0311036 | A1 * | 12/2009 | Pires | A45D 34/04 | 401/263 |

FOREIGN PATENT DOCUMENTS

| | | | |
|---|---|---|---|
| KR | 20-2010-0002400 | U | 3/2010 |
| KR | 20-2010-0006433 | U | 6/2010 |
| KR | 10-1390993 | B1 | 5/2014 |

* cited by examiner

Prior Art

APPLICATOR HAVING PRESS BUTTON FOR DISCHARGING GEL-TYPE CONTENTS

CROSS-REFERENCE TO RELATED APPLICATION

This application claims the benefit of Korean application No. 20-2014-0009265, filed on Dec. 16, 2014 with the Korean Intellectual Property Office, the disclosure of which is incorporated herein by reference.

TECHNICAL FIELD

The present invention relates to an applicator having a press button for discharging gel-type contents, and more specifically, an applicator having a press button for discharging gel-type contents, the applicator including: a pump embedded in a container body; a pressing member coupled to the upper side of the pump; a link coupled to the pressing member; and a press button formed on the outside of the link. If the press button is pressed, the link is pressed, then the pressing member connected to the link presses the pump vertically, and thereby the gel-type contents filled in the container body are pumped, and discharged through a discharge member. Thus, a predetermined amount of gel-type contents can always easily be discharged for use.

BACKGROUND ART

In general, cosmetic products or pharmaceutical and quasi-pharmaceutical products in the form of gel-type contents are widely used to effectively apply the contents to an application area.

The gel-type contents, which are filled in a glass container or a tube container, are used in such a manner that users take some of the gel-type contents on their hands for use, or squeeze the gel-type contents from the tube container and apply the gel-type contents by using the hands or a tool such as a puff and a cotton swab.

However, according to the above conventional manner, if a tool such as the puff or the cotton swab is used to apply the gel-type contents, the used puff or cotton swab is discarded in a state that the gel-type contents are put on the puff or the cotton swab, so that the gel-type contents are wasted. In addition, the users get the gel-type contents on their hands every time the gel-type contents are applied using the hands, so that it is inconvenient to use the gel-type contents because it is necessary to wash the hands every time after use. In addition, as the hands where the gel-type contents are put on are washed as described above, the content loss occurs.

To solve the above problems, as shown in FIG. 1, the applicant of the present invention has filed Korean Utility Model Registration No. 20-0439672, which discloses that when a user presses a side button that is exposed to the outside of an outer container while making contact with an outer side of a rubber pump which is formed of rubber at an inner side of the container, the rubber pump is pressed together with the side button, so that gel-type contents filled in the container are discharged by the pressure. In addition, since an application member is coupled to the container, the pumped gel-type contents are discharged to the application member, so that other tools are not required to apply the gel-type contents, and the gel-type contents can be easily used without getting the gel-type contents on the hands.

However, according to the related art, a pocket-shaped rubber pump is pressed together with the side button when the side button is pressed, the entire surface of the rubber pump may not be pressed when pressing the rubber pump because the rubber pump has a pocket shape, so that a part of the rubber pump in which the pressure is not applied is inflated. Thus, it is impossible to discharge a constant amount of contents, so that different, amounts of contents are discharged every time the pressure is applied, which makes it is difficult to control a discharge amount of the contents.

DISCLOSURE

Technical Problem

To solve the problems described above, one object of the present invention is to provide an applicator having a press button for discharging gel-type contents, the applicator including: a pump embedded in a container body; a pressing member coupled to the upper side of the pump; a link coupled to the pressing member; and a press button formed on the outside of the link. If the press button is pressed, the link is pressed, then the pressing member connected to the link presses the pump vertically, and thereby the gel-type contents filled in the container body are pumped, and discharged through a discharge member. Thus, a predetermined amount of gel-type contents can always easily be discharged for use.

Technical Solution

According to the present invention, there is provided an applicator having a press button for discharging gel-type contents, the applicator including:

a container body (10) accommodated therein with the contents;

a push plate (20) provided inside the container body (10);

a sealing member (30) mounted on an upper end of the container body (10) and formed at a center thereof with a content suction hole (31);

a pump (40) mounted on an upper portion of the sealing member (30);

a pressing member (50) coupled to an upper portion of the pump (40) to vertically press the pump (40);

a container upper body (60) coupled to an upper portion of the container body (10) and having one side coupled to a press button (61);

a shoulder (70) coupled to an upper portion of the container upper body (60) and provided at an upper side thereof with a discharge member (80); and a link (L) that connects the pressing member (50) and the shoulder (70), and has a link coupling shaft (L3), wherein the link coupling shaft (L3) makes close contact with an inner side of the press button (61).

In addition, the shoulder (70) may be coupled to the discharge member (80) which is formed separately from the shoulder (70).

In addition, a fixing member (75) may be fitted to a lower extension annular protrusion (72) of the shoulder (70) while being seated on an upper side surface of the pressing member (50).

In addition, the discharge member (80) may be formed therein with a discharge channel (82), and may have an upper end formed in a spherical shape or a hemispherical shape so as to provide soft tactile sensation when rubbed onto skin.

In addition, the link (L) may include: a first link (L1) connected to a first link connection protrusion (52) of the pressing member (50); and a second link (L2) connected to a second link connection protrusion (76) of the shoulder (70)

or the fixing member (75), wherein the first link (L1) and the second link (L2) are connected to each other by the link coupling shaft (L3), and the link coupling shaft (L3) makes close contact with the inner side of the press button (61).

In addition, one or two links (L), preferably two links (L), may be provided.

Advantageous Effects

According to the present invention, an applicator having a press button for discharging gel-type contents includes: a pump embedded in a container body; a pressing member coupled to the upper side of the pump; a link coupled to the pressing member; and a press button formed on the outside of the link. If the press button is pressed, the link is pressed, then the pressing member connected to the link presses the pump vertically, and thereby the gel-type contents filled in the container body are pumped, and discharged through a discharge member. Thus, a predetermined amount of gel-type contents can always easily be discharged for use.

BEST MODE

Mode for Invention

Hereinafter, an applicator having a press button for discharging gel-type contents according to an embodiment of the present invention will be described with reference to accompanying drawings.

Figure 1:
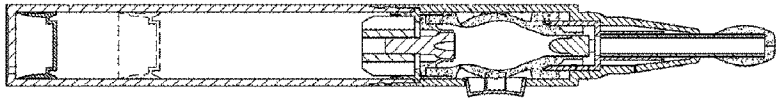
FIG. 1 shows a container for discharging a constant amount of contents according to the related art.
Figure 2:
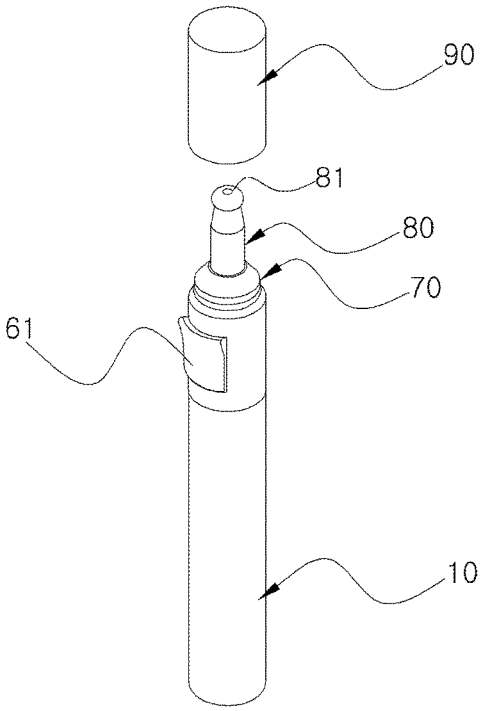
FIG. 2 is a perspective view showing an applicator having a press button for discharging gel-type contents according to the present invention.
Figure 3:
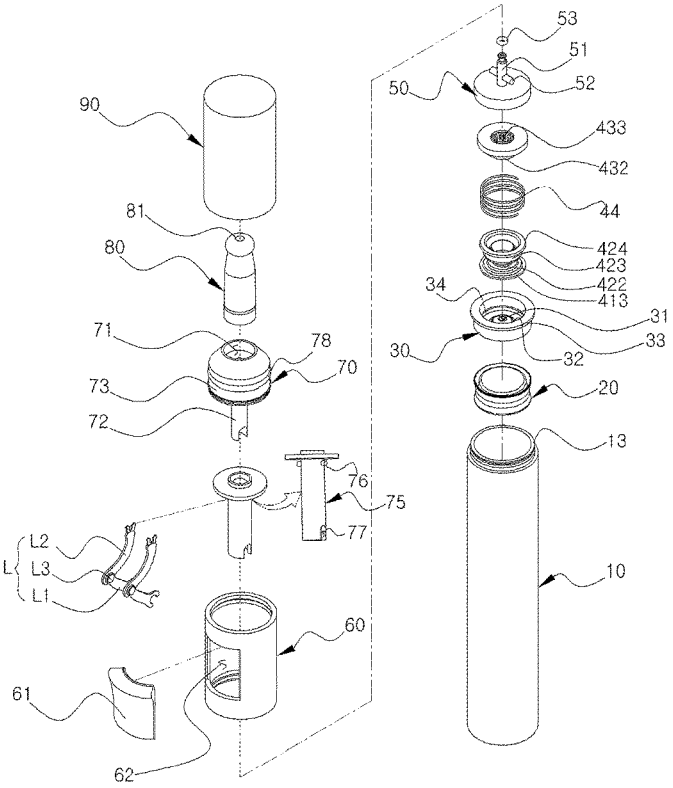
FIG. 3 is an exploded perspective view showing the applicator having the press button for discharging the gel-type contents according to the present invention.
Figure 4:
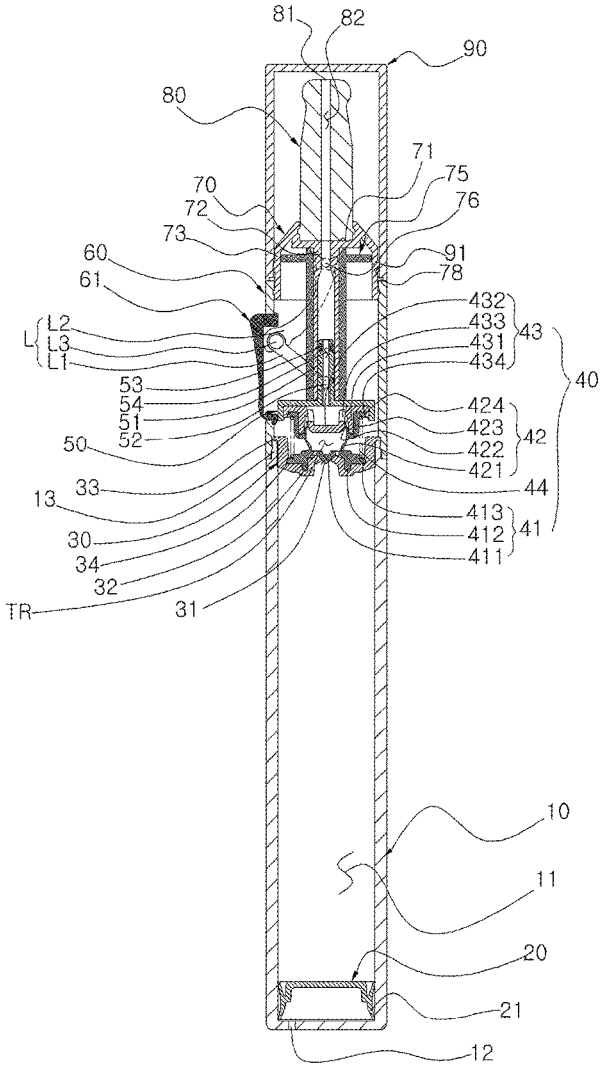
FIG. 4 is a sectional view showing the applicator having the press button for discharging the gel-type contents according to the present invention.
Figure 5:
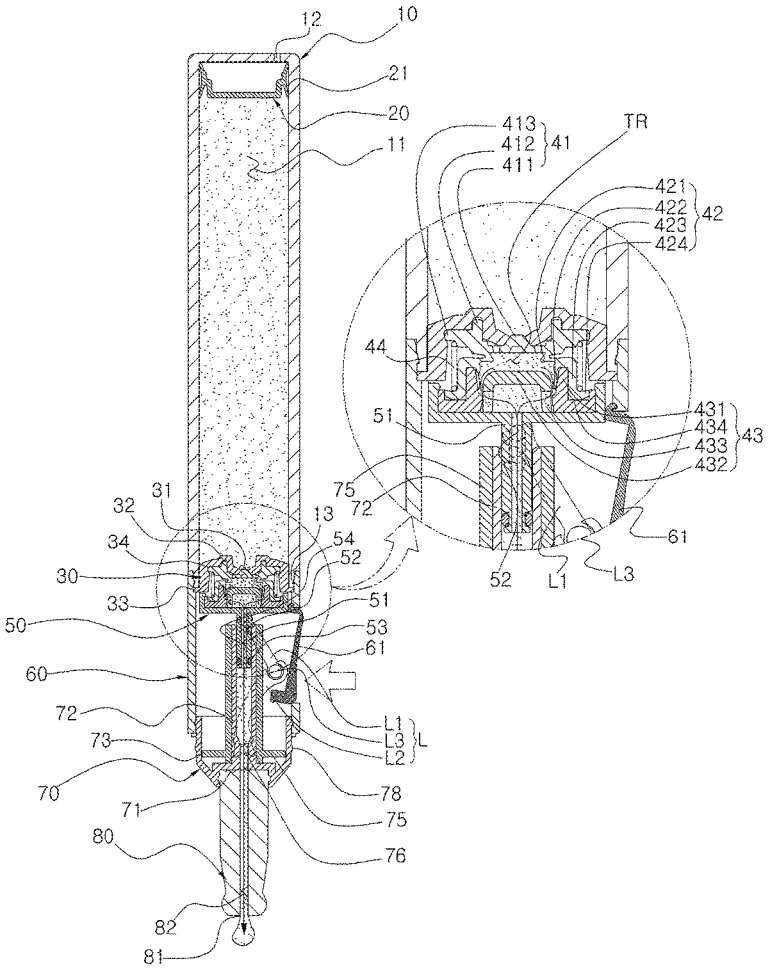
FIG. 5 is a sectional view showing a state of pressing the press button of the applicator having the press button for discharging the gel-type contents according to the present invention.
Figure 6:
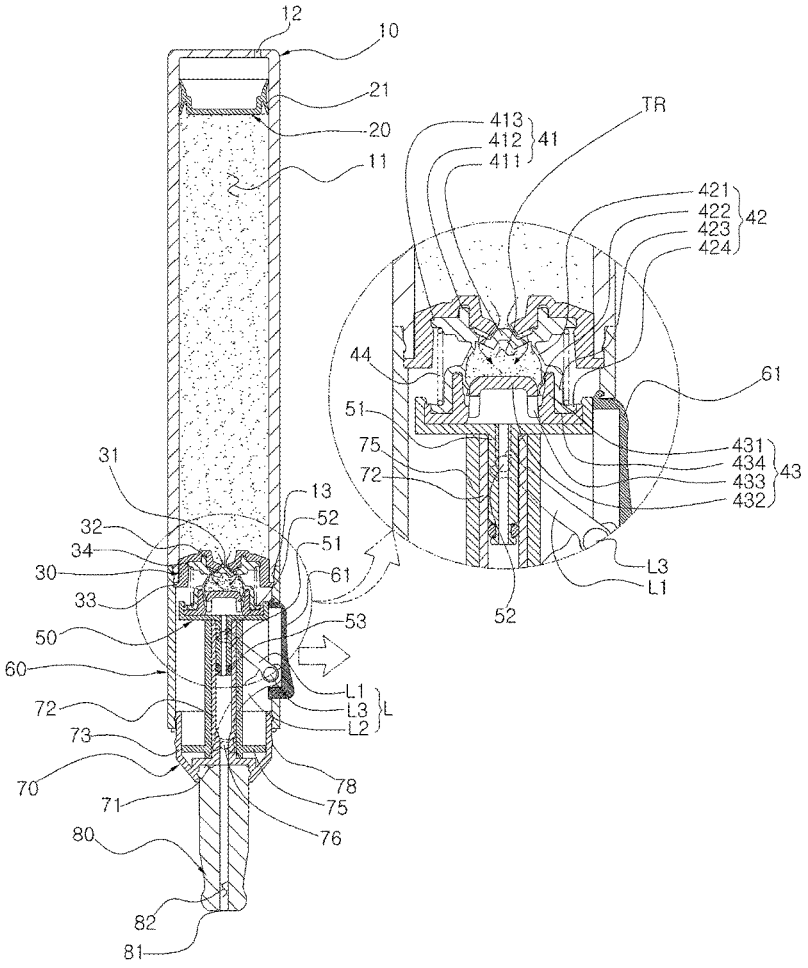
FIG. 6 is a sectional view showing a state of releasing the pressing force applied to the press button of the applicator having the press button for discharging the gel-type contents according to the present invention.

FIG. 2 is a perspective view showing an applicator having a press button for discharging gel-type contents according to the present invention, FIG. 3 is an exploded perspective view showing the applicator having the press button for discharging the gel-type contents according to the present invention, FIG. 4 is a sectional view showing the applicator having the press button for discharging the gel-type contents according to the present invention, FIG. 5 is a sectional view showing a state of pressing the press button of the applicator having the press button for discharging the gel-type contents according to the present invention, and FIG. 6 is a sectional view showing a state of releasing the pressing force applied to the press button of the applicator having the press button for discharging the gel-type contents according to the present invention.

As shown in FIGS. 2 to 4, according to the embodiment of the present invention, the applicator having the press button for discharging the gel-type contents includes: a container body 10 accommodated therein with the contents; a push plate 20 provided inside the container body 10; a sealing member 30 mounted on an upper end of the container body 10 and formed at a center thereof with a content suction hole 31; a pump 40 mounted on an upper portion of the sealing member 30; a pressing member 50 coupled to an upper portion of the pump 40 to vertically press the pump 40; a container upper body 60 coupled to an upper portion of the container body 10 and having one side coupled to a press button 61; a shoulder 70 coupled to an upper portion of the container upper body 60 and provided at an upper side thereof with a discharge member 80; and a link L that connects the pressing member 50 and the shoulder 70, and has a link coupling shaft L3, wherein the link coupling shaft L3 makes close contact with an inner side of the press button 61.

The container body 10 is formed therein with a content accommodation space 11 which is accommodated therein with the gel-type contents, and formed at a lower end thereof with an air flow hole 12 through which external is introduced.

The container body 10 is formed at an upper side thereof with an inlet portion 13, and the inlet portion 13 is provided at an outer periphery thereof with an undercut or a screw thread, which is coupled with the container upper body 60.

The push plate 20 serves to push up the gel-type contents accommodated in the content accommodation space 11 of the container body 10, and a push plate blade 21 is integrally formed with an outer side of the push plate 20 and makes close contact with an inner side surface of the container body 10.

The content suction hole 31 of the sealing member 30 is formed at an outer side thereof with a pump mounting groove 32 on which the pump 40 is mounted, and the pump mounting groove 32 is provided at an outer upper portion thereof with a step portion 33 seated on the upper end of the container body 10 and fixed between the container body 10 and the container upper body 60. The sealing member 30 is formed at an inner side surface thereof with a pump coupling groove 34 to which a pump bottom plate horizontal extension piece 413 of the pump 40 is fitted.

The step portion 33 of the sealing member 30 is seated on the upper end of the inlet portion 13 of the container body 10, and fixed between the container body 10 and the container upper body 60.

The pump 40 includes: a pump bottom plate 41; a pump body 42 integrally formed on the pump bottom plate 41 and extending therefrom; a valve body 43 coupled to an upper portion of the pump body 42; and an elastic member 44 mounted on an outer side of the pump body 42.

A suction valve 411 for selectively blocking the content suction hole 31 of the sealing member 30 is provided at a center of a lower side surface of the pump bottom plate 41, a pump mounting protrusion 412 inserted, into the pump mounting groove 32 of the sealing member 30 is provided at an outer side of the suction valve 411, and a pump bottom plate horizontal extension piece 413 fitted to the pump coupling groove 34 of the sealing member 30 extends from an outer side of the pump mounting protrusion 412.

The pump body 42 includes: an elastic support 421 integrally formed an upper portion of the pump bottom plate 41, having a cylindrical shape, and formed of an elastic material; a valve 422 formed of an elastic material and extending upwards from the elastic support 421; an upper extension piece 423 spaced outwards from the valve 422 by a predetermined distance; and a pump body horizontal extension piece 424 horizontally extending from an end of the upper extension piece 423.

The valve body 43 includes: a lower extension piece 431 fitted between an upper extension piece 423 and a valve 422 of the pump body 42; a blocking plate 432 protruding downwards from a center of the valve body 43; and a plurality of content discharge holes 433 formed on an outer circumferential surface of the blocking plate 432.

In addition, the lower extension piece 431 of the valve body 34 is formed at an outer side thereof with a pump body coupling groove 434 into which the pump body horizontal extension piece 424 of the pump body 42 is inserted.

It is preferred, that the suction valve 411 of the pump bottom plate 41, and the valve 422 and the elastic support 421 of the pump body 42 are formed of at least one of elastomer, silicone rubber, acrylonitrile-butadiene rubber (NBR), polyethylene (PE), and polypropylene (PP).

The pressing member 50 is moved up and down by the link L to press the pump 40.

In upper extension annular protrusion 51 is integrally formed with the pressing member 50 and extends upwards from a center of the pressing member 50. The upper extension annular protrusion 51 is formed therein with a discharge flow path 54 through which the contents are discharged, provided on one side thereof with a first link connection protrusion 52, and provided at an upper outer periphery thereof with a sealing ring 53.

The container upper body 60 is formed at one side thereof with a press button insertion groove 62 into which the press button 61 is inserted.

The container upper body 60 is coupled to an outer periphery of the inlet portion 13 of the container body 10 while fixing the sealing member 30 by pushing the sealing member.

The shoulder 70 may be coupled to the discharge member 80 which is formed separately from the shoulder 70.

The shoulder 70 is formed at an upper side thereof with a discharge member insertion groove 71 into which the discharge member 80 is inserted, and a lower extension annular protrusion 72, which is fitted to an outer side of the upper extension annular protrusion 51 of the pressing member 50, is integrally formed on a central lower side of the shoulder 70 and extends therefrom, and the lower extension annular protrusion 72 is provided at an outer side thereof with an outer wall 73 coupled to the container cap 60.

In addition, a fixing member 75 may be fitted to the lower extension annular protrusion 72 of the shoulder 70 while being seated on an upper side surface of the pressing member 50.

*The fixing member 75 is formed at one lower side thereof with a link groove 77 into which the first link connection protrusion 52 of the pressing member 50 is inserted.

A second link connection protrusion 76 is provided at an outer circumferential surface of the lower extension annular protrusion 72 of the shoulder 70, or at one upper side of the fixing member 75.

The discharge member 80 is formed therein with a discharge channel 82, and it is preferred that the discharge member 80 has an upper end formed in a spherical shape or a hemispherical shape so as to provide soft tactile sensation when rubbed onto skin.

The link L serves to press the pump 40 by moving the pressing member 50 toward the container body 10 by the pressing force applied through the press button 61 coupled to a side surface of the container upper body 60.

The link L includes: a first link L1 connected to a first link connection protrusion 52 of the pressing member 50; and a second link L2 connected to a second link connection protrusion 76 of the shoulder 70 or the fixing member 75, wherein the first link L1 and the second link L2 are connected to each other by the link coupling shaft L3, and the link coupling shaft L3 makes close contact with the inner side of the press button 61.

The link L may be provided on one side or both sides of an outer surface of a fixing member 75, preferably, both sides of the outer surface of the fixing member 75.

A lid 90 is provided to prevent the discharge member 80 from being exposed to the outside during storage or distribution. The lid 90 is formed at a lower inner periphery thereof with a groove 91 which is coupled to a detachable protrusion 78 provided on an outer periphery of the shoulder 70.

Hereinafter, a method of assembling the applicator having the press button for discharging the gel-type contents, which has a structure as described above, will be described.

First, as shown in FIGS. 3 and 4, the push plate 20 is inserted into the container body 10, the gel-type contents are injected into the content accommodation space 11 of the container body 10, and then the step portion 33 of the sealing member 30 is seated on the upper end of the inlet portion 13 of the container body 10.

Then, the pump 40 is coupled to the upper portion of the sealing member 30. In detail, the pump mounting protrusion 412 of the pump bottom plate 41 in which the pump body 42 is integrally formed and the elastic member 44 is mounted on the outer side of the pump bottom plate 41 is fitted to the pump mounting groove 32 of the sealing member 30 while fitting the pump bottom plate horizontal extension piece 413 of the pump bottom plate 41 to the pump coupling groove 34 of the sealing member 30, the lower extension piece 431 of the valve body 43 is fitted between the upper extension piece 423 and the valve 422 of the pump body 42, and then the pressing member 50 is mounted on the upper side of the valve body 43.

Thereafter, the fixing member 75 is fitted to the outside of the upper extension annular protrusion 51 of the pressing member 50, and the first link connection protrusion 52 of the pressing member 50 and the second link connection protrusion 76 of the fixing member 75 are respectively connected to the first link L1 and the second link L2, which are connected to each other by the link coupling shaft L3. At this time, the link L may be provided on one side or both sides of the outer surface of the fixing member 75.

Next, the container upper body 60 to which the press button 61 is coupled is coupled to the upper end of the inlet portion 13 of the container body 10 to fix the sealing member 30, and the shoulder 70 to which the discharge member 80 is coupled is coupled to the upper side of the container upper body 60, such that the lower extension annular protrusion 72 of the shoulder 70 is fitted between the fixing member 75 and the upper extension annular protrusion 51 of the pressing member 50.

Finally, the lid is coupled to the outside of the shoulder (70).

Hereinafter, the operation of the applicator having the press button for discharging the gel-type contents, which has a structure as described above, will be described.

In order to use the applicator having the press button for discharging the gel-type contents, as shown in FIG. 5, the lid 90 is firstly separated from the container body 10, and the press button 61 coupled to the side surface of the container upper body 60 is pressed.

When the press button 61 is pressed, the link coupling shaft L3, which makes close contact with the inner side of the press button 61, is pushed inward of the container upper body 60, which allows the pressing member 50 connected to the first link L1 to move toward the container body 10, while the shoulder 70 or the fixing member 75 connected to the second link L2 is fixed.

As the valve body 43 of the pump 40 and the pump body 42 coupled to the valve body 43 are pressed by the movement of the pressing member 50, the elastic support 421 of the pump body 42 is folded, thereby reducing the volume of a content temporary storage space TR.

Accordingly, the pressure is generated in the content temporary storage space TR. In addition, as the contents inside the content temporary storage space TR are to be discharged to the outside by the above pressure, discharge pressure is generated, which allows the suction valve 411 of the pump bottom plate 41 to close the content suction hole 31 of the sealing member 30.

At the same time, the contents in the content temporary storage space TR separate the valve 422, which is formed of an elastic material and makes close contact with the outer side surface of the blocking plate 432 of the valve body 43, from the blocking plate 432 of the valve body 43 so as to open the discharge hole 433. In addition, after the gel-type contents, flow out through the discharge hole 433, the gel-type contents are discharged to the outside through an outlet 81 and the discharge channel 82 of the discharge member 80.

Thereafter, as shown in FIG. 6, when the pressure force applied to the press button 61 is released, the volume of the content temporary storage space TR is increased as the shape of the elastic support 421 of the pump body 42 is restored by the elasticity of the elastic member 44 and the elastic support 421, so that the vacuum pressure is generated.

Accordingly, the valve 422 of the pump body 42 makes close contact with the blocking plate 432 of the valve body 43 so as to close the content discharge hole 433, and simultaneously, the content suction hole 31 of the sealing member 30 is opened as the suction valve 411 of the pump bottom plate 41 is lifted by the vacuum pressure generated inside the content temporary storage space TR. Therefore, the contents accommodated in the content accommodation space 11 of the container body 10 are introduced into the content temporary storage space TR through the content suction hole 31.

As described above, although the applicator having the press button for discharging the gel-type contents according to one embodiment of the present invention has been described for illustrative purposes, the present invention is not limited thereto. It is understood that various changes and modifications can be made by those skilled in the art without departing from the spirit and scope of the present invention as disclosed in the accompanying claims.

[Description of Reference numerals]

| | |
|---|---|
| 10: Container body | 11: Content accommodation space |
| 12: Air flow hole | 13: Inlet portion |
| 20: Push plate | 21: Push plate blade |
| 30: Sealing member | 31: Content suction hole |
| 32: Pump mounting groove | 33: Step portion |
| 34: Pump coupling groove | 40: Pump |

-continued

[Description of Reference numerals]

| | |
|---|---|
| 41: Pump bottom plate | 411: Suction valve |
| 412: Pump mounting protrusion | |
| 413: Pump bottom plate horizontal extension piece | |
| 42: Pump body | 421: Elastic support |
| 422: Valve | 423: Upper extension piece |
| 424: Pump body horizontal extension piece | |
| 43: Valve body | 431: Lower extension piece |
| 432: Blocking plate | 433: Content discharge hole |
| 434: Pump body coupling groove | 50: Pressing member |
| 51: Upper extension annular protrusion | |
| 52: First link connection protrusion | |
| 53: Sealing ring | 54: Discharge flow path |
| 60: Container upper body | 61: Press button |
| 62: Press button insertion groove | 70: Shoulder |
| 71: Discharge member insertion groove | |
| 72: Lower extension annular protrusion | |
| 73: Outer wall | 75: Fixing member |
| 76: Second link connection protrusion | |
| 77: Link groove | 78: Detachable protrusion |
| 80: Discharge member | 81: Outlet |
| 82: Discharge channel | 90: Lid |
| 91: Groove | L: Link |
| L1: First link | L2: Second link |
| L3: Link coupling shaft | |
| TR: Content temporary storage space | |

The invention claimed is:

1. An applicator having a press button for discharging gel-type contents, the applicator comprising:

a container body (10) accommodated therein with the contents;

a push plate (20) provided inside the container body (10);

a sealing member (30) mounted on an upper end of the container body (10) and formed at a center thereof with a content suction hole (31);

a pump (40) mounted on an upper portion of the sealing member (30);

a pressing member (50) coupled to an upper portion of the pump (40) to vertically press the pump (40);

a container upper body (60) coupled to an upper portion of the container body (10) and having one side coupled to a press button (61);

a shoulder (70) coupled to an upper portion of the container upper body (60) and provided at an upper side thereof with a discharge member (80); and a link (L) that connects the pressing member (50) and the shoulder (70), and has a link coupling shaft (L3), wherein the link coupling shaft (L3) makes close contact with an inner side of the press button (61), and a fixing member (75) is fitted to a lower extension annular protrusion (72) of the shoulder (70) while being seated on an upper side surface of the pressing member (50).

2. An applicator having a press button for discharging gel-type contents, the applicator comprising:

a container body (10) accommodated therein with the contents;

a push plate (20) provided inside the container body (10);

a sealing member (30) mounted on an upper end of the container body (10) and formed at a center thereof with a content suction hole (31);

a pump (40) mounted on an upper portion of the sealing member (30);

a pressing member (50) coupled to an upper portion of the pump (40) to vertically press the pump (40);

a container upper body (60) coupled to an upper portion of the container body (10) and having one side coupled to a press button (61);

a shoulder (70) coupled to an upper portion of the container upper body (60) and provided at an upper side thereof with a discharge member (80); and a link (L) that connects the pressing member (50) and the shoulder (70), and has a link coupling shaft (L3), wherein the link coupling shaft (L3) makes close contact with an inner side of the press button (61), and the link (L) is provided on one side or both sides of an outer surface of a fixing member (75).

3. The applicator of claim 1, wherein the pump (40) comprises:

a pump bottom plate (41);

a pump body (42) integrally formed on the pump bottom plate (41) and extending therefrom;

a valve body (43) coupled to an upper portion of the pump body (42); and an elastic member (44) mounted on an outer side of the pump body (42).

4. The applicator of claim 3, wherein a suction valve (411) for selectively blocking the content suction hole (31) of the sealing member (30) is provided at a center of a lower side surface of the pump bottom plate (41), a pump mounting protrusion (412) inserted into a pump mounting groove (32) of the sealing member (30) is provided at an outer side of the suction valve (411), and a pump bottom plate horizontal extension piece (413) extends from an outer side of the pump mounting protrusion (412).

5. The applicator of claim 3, wherein the pump body (42) comprises:

an elastic support (421) integrally formed on an upper portion of the pump bottom plate (41), having a cylindrical shape, and formed of an elastic material;

a valve (422) formed of an elastic material and extending upwards from the elastic support (421);

an upper extension piece (423) spaced outwards from the valve (422) by a predetermined distance; and a pump body horizontal extension piece (424) horizontally extending from an end of the upper extension piece (423).

6. The applicator of claim 3, wherein the valve body (43) comprises:

a lower extension piece (431) fitted between an upper extension piece (423) and a valve (422) of the pump body (42);

a blocking plate (432) protruding downwards from a center of the valve body (43); and a plurality of content discharge holes (433) formed on an outer circumferential surface of the blocking plate (432).

7. The applicator of claim 3, wherein a suction valve (411) of the pump bottom plate (41), and a valve (422) and an elastic support (421) of the pump body (42) are formed of at least one of elastomer, silicone rubber, acrylonitrile-butadiene rubber (NBR), polyethylene (PE), and polypropylene (PP).

8. The applicator of claim 1, wherein the shoulder (70) is coupled to the discharge member (80) which is formed separately from the shoulder (70).

9. The applicator of claim 1, wherein the discharge member (80) has an upper end formed in a spherical shape or a hemispherical shape so as to provide soft tactile sensation when rubbed onto skin.

10. The applicator of claim 1, wherein the link (L) comprises:

a first link (L1) connected to a first link connection protrusion (52) of the pressing member (50); and a second link (L2) connected to a second link connection protrusion (76) of the shoulder (70) or the fixing member (75).

11. The applicator of claim 10, wherein the first link (L1) and the second link (L2) are connected to each other by the link coupling shaft (L3), and the link coupling shaft (L3) makes close contact with the inner side of the press button (61).

12. The applicator of claim 2, wherein the pump (40) comprises:

a pump bottom plate (41);

a pump body (42) integrally formed on the pump bottom plate (41) and extending therefrom;

a valve body (43) coupled to an upper portion of the pump body (42); and an elastic member (44) mounted on an outer side of the pump body (42).

13. The applicator of claim 12, wherein a suction valve (411) for selectively blocking the content suction hole (31) of the sealing member (30) is provided at a center of a lower side surface of the pump bottom plate (41), a pump mounting protrusion (412) inserted into a pump mounting groove (32) of the sealing member (30) is provided at an outer side of the suction valve (411), and a pump bottom plate horizontal extension piece (413) extends from an outer side of the pump mounting protrusion (412).

14. The applicator of claim 12, wherein the pump body (42) comprises:

an elastic support (421) integrally formed on an upper portion of the pump bottom plate (41), having a cylindrical shape, and formed of an elastic material;

a valve (422) formed of an elastic material and extending upwards from the elastic support (421);

an upper extension piece (423) spaced outwards from the valve (422) by a predetermined distance; and a pump body horizontal extension piece (424) horizontally extending from an end of the upper extension piece (423).

15. The applicator of claim 12, wherein the valve body (43) comprises:

a lower extension piece (431) fitted between an upper extension piece (423) and a valve (422) of the pump body (42);

a blocking plate (432) protruding downwards from a center of the valve body (43); and a plurality of content discharge holes (433) formed on an outer circumferential surface of the blocking plate (432).

16. The applicator of claim 12, wherein a suction valve (411) of the pump bottom plate (41), and a valve (422) and an elastic support (421) of the pump body (42) are formed of at least one of elastomer, silicone rubber, acrylonitrile-butadiene rubber (NBR), polyethylene (PE), and polypropylene (PP).

17. The applicator of claim 2, wherein the shoulder (70) is coupled to the discharge member (80) which is formed separately from the shoulder (70).

18. The applicator of claim 2, wherein the discharge member (80) has an upper end formed in a spherical shape or a hemispherical shape so as to provide soft tactile sensation when rubbed onto skin.

19. The applicator of claim 2, wherein the link (L) comprises:

a first link (L1) connected to a first link connection protrusion (52) of the pressing member (50); and a second link (L2) connected to a second link connection protrusion (76) of the shoulder (70) or the fixing member (75).

20. The applicator of claim 19, wherein the first link (L1) and the second link (L2) are connected to each other by the link coupling shaft (L3), and the link coupling shaft (L3) makes close contact with the inner side of the press button (61).

* * * * *